United States Patent [19]

Oya et al.

[11] Patent Number: 5,035,284

[45] Date of Patent: Jul. 30, 1991

[54] PLATE-FIN-TYPE HEAT EXCHANGER

[75] Inventors: Junichi Oya, Sakai; Shoichi Kashima, Osaka, both of Japan

[73] Assignee: Sumitomo Presicion Products Co. Ltd., Gyogo, Japan

[21] Appl. No.: 445,665

[22] PCT Filed: Dec. 22, 1988

[86] PCT No.: PCT/JP88/01291

§ 371 Date: Dec. 7, 1989

§ 102(e) Date: Dec. 7, 1989

[87] PCT Pub. No.: WO89/05951

PCT Pub. Date: Jun. 29, 1989

[30] Foreign Application Priority Data

Dec. 24, 1987 [JP] Japan ..... 297156

[51] Int. Cl.[5] ..... F28F 13/00

[52] U.S. Cl. ..... 165/146; 165/166

[58] Field of Search ..... 165/146, 166, 167

[56] References Cited

U.S. PATENT DOCUMENTS

| | | | |
|---|---|---|---|
| 2,566,310 | 9/1951 | Burns et al. | 165/166 |
| 3,223,152 | 12/1965 | Schulenberg | 165/146 |
| 3,322,189 | 5/1967 | Topouzian | 165/166 X |
| 3,992,168 | 11/1976 | Toyama et al. | 165/166 X |
| 4,049,051 | 9/1977 | Parker | 165/166 |
| 4,434,845 | 3/1984 | Steeb | 165/153 |
| 4,473,111 | 9/1984 | Steeb | 165/153 |
| 4,623,019 | 11/1986 | Wiard | 165/146 |

FOREIGN PATENT DOCUMENTS

| | | |
|---|---|---|
| 0212878 | 3/1987 | European Pat. Off. . |
| 1516432 | 3/1967 | France . |
| 2085924 | 12/1971 | France . |
| 2563620 | 10/1985 | France . |

*Primary Examiner*—Allen J. Flanigan

*Attorney, Agent, or Firm*—Watson, Cole, Grindle & Watson

[57] ABSTRACT

A plate-fin-type heat exchanger for transferring heat from a hot fluid to a cold fluid includes stacked plates having fins therebetween that define alternate interdigitated first and second fluid passages, the fins defining the first fluid passages having a high coefficient of heat transfer and a large area of heat transfer and the fins defining the second fluid passages having a low coefficient of heat transfer and a small area of heat transfer. Either the hot fluid or the cold fluid is continuously passed through the first fluid passages and the other fluid is intermittently passed through the second fluid passages.

4 Claims, 1 Drawing Sheet

PLATE-FIN-TYPE HEAT EXCHANGER

BACKGROUND OF THE INVENTION

1. Technical Field

The present invention relates to a plate-fin-type heat exchanger wherein a high temperature fluid or a low temperature fluid flows continuously therethrough, while the other flows intermittently therethrough, and relates to a plate-fin-type heat exchanger wherein thermal fatigue produced particularly in a separating plate partitioning between the passages through which the high temperature fluid flows and the passages through which the low temperature fluid flows is alleviated.

2. Background Art

The plate-fin-type heat exchanger has a large area of heat transfer per unit area and a high coefficient of heat transfer, and therefore has an advantage in that it is compact and easily made in comparison with other types, particularly tube type heat exchangers.

Also, the plate-fin-type heat exchanger has a wide range of selection of design such that the fin pitch, the fin height and the fin shape suitable for the nature and the purpose of the fluid flowing through each passage can be properly selected, and further the number of laminations of fins can be selected arbitrarily, and thereby an efficient design can be made, so that it has been used for a variety of applications.

On the other hand, where such a plate-fin-type heat exchanger is applied to the case where one of a higher temperature fluid and a low temperature fluid performs continuous operation and the other operates intermittently, the temperature of the separating plate which is a partition plate between the fluid passages is largely varied repeatedly, and therefore thermal fatigue is produced, and a long-time use thereof might result in damage.

For the plate-fin-type heat exchanger having the above-mentioned configuration, the temperature of the separating plate between the adjacent passages during operation is given by the following equation.

$$\text{From } Q = hA_H(T_H - T_W) = hA_L(T_W - T_L),$$

$$T_W = T_H - \frac{Q}{hA_H} = \frac{Q}{hA_L} - T_L$$

$$T_W = T_H - \frac{(T_H - T_L)\,hA_L}{hA_H + hA_L} = T_L + \frac{(T_H - T_L)\,hA_H}{hA_H + hA_L}$$

where,

Q: Quantity of heat exchange (Kcal/hr)

$hA_H$: Coefficient of heat transfer x area of heat transfer (Kcal/h°C.) of high temperature side $hA_L$: Coefficient of heat transfer x area of heat transfer (Kcal/h°C.) of low temperature side.

$T_H$: Temperature of fluid of high temperature side, °C.

$T_L$: Temperature of fluid of low temperature side, °C.

$T_W$: Temperature

Here, consideration is made on the temperature of the separating plate in intermittent operation.

When the high temperature side is in normal operation, and the low temperature side is in the stopped state, $$T_W = T_H.$$

When the high temperature side is in normal operation, and the low temperature side starts to operate, the temperature $T_W$ is reduced, being balanced at a certain temperature.

Taking the temperature of the separating plate when the low temperature side is inactive as $T_{W1}(=T_H)$, and the temperature of the plate balanced after a lapse of some time from start of operation of the low temperature side as $T_{W2}$, the temperature of the separating plate varies repeatedly between $T_{W1}(=T_H)$ and $T_{W2}$. No problem exists if this variation in temperature takes place slowly and uniformly, but actually, this variation occurs in a nonuniform fashion, causing generation of thermal stress.

Next, taking the amount of change in the temperature as $(T_{W1} - T_{W2}) = \Delta T_W$, thermal stress is expressed by the following general equation.

$$\sigma = E a x \Delta T_W$$

E: Young's modulus a: Coefficient of thermal expansion of separating plate,/°C.

$\Delta TW$: $(T_{W1} - T_{W2})$

As shown by the above equation, as the amount $\Delta T$ becomes smaller, the thermal stress becomes smaller and the life or durability is increased.

However, for the plate-fin-type heat exchanger wherein either of the high temperature fluid and the low temperature fluid passes through intermittently, no heat exchanger has been proposed which has a configuration that the variation in the temperature of the separating plate between the passages is positively minimized, and conventionally materials being resistant to thermal stress have been selected.

The present invention proposes to provide a plate-fin-type heat exchanger wherein the thermal fatigue is alleviated which is produced in the separating plate partitioning between the high temperature passage and the low temperature passage of the plate-fin-type heat exchanger wherein one of the high temperature fluid and the low temperature fluid is operated continuously, while the other repeats intermittent operation, and thereby the life of the heat exchanger is extended.

SUMMARY OF THE INVENTION

In the present invention, in a heat exchanger wherein one of a high temperature fluid and a low temperature fluid performs continuous operation, while the other repeats intermittent operation, a plate-fin-type heat exchanger having a configuration capable of alleviating thermal fatigue produced in a separating plate partitioning between a passage of high temperature side and a passage of low temperature side is aimed and various studies have been conducted, and as a result, considering that a corrugated fin which is the feature of the plate-fin-type heat exchanger can be selected arbitrarily, the ratio of hAs (coefficient of heat transfer x area of heat transfer) of the passages is increased, and thereby the amount of variation in the temperature of the separating plate repeated intermittently can be decreased, and it has been found that a reduction in life due to thermal fatigue can be improved.

This means that the present invention is:

In a plate-fin-type heat exchanger wherein one of a fluid of high temperature side and a fluid of low temperature side performs continuous operation, while the other repeats intermittent operation, a plate-fin-type heat exchanger characterized in that passages of the fluid of continuous operation side are disposed outside, and dummy passages passing no fluid are disposed in a laminated fashion on the outermost side, and fins having a high coefficient of heat transfer and a large area of heat transfer are used for a fluid passage of continuous operation side, and fins having a low coefficient of heat transfer and a small area of heat transfer are used for a fluid passage of intermittent operation side.

Further detailed description is made on the present invention.

Where the continuous operation side is a passage of heat medium as shown in the embodiment, the plate-fin-type heat exchanger is configurated in a manner that the passages of high temperature side of a configuration that a corrugated fin is incorporated between two plates and the both ends are closed with side bars and the passages of low temperature side of nearly the same construction are laminated alternately, and the dummy passages which have nearly the same construction as each passage and pass no fluid are laminated outside the both end passages respectively, and further (1) the fin having a high coefficient of heat transfer and a large area of heat transfer is used for the passage wherethrough the heat medium passes continuously during operation, and the fin having a low coefficient of heat transfer and a small area of heat transfer is used for the passage wherethrough the heat medium passes intermittently in a certain time cycle during operation, and the ratio of hAs (coefficient of heat transfer x area of heat transfer) is increased, (2) the passage continuously passing the heat medium is disposed outside the passage of intermittent side, and (3) the number of the dummy passages of the outermost side of the heat exchanger core are set to two or more. Or, further, (4) it is desirable to use the corrugated fin of the lower half of the inlet side of the heat exchanging part in the passage of intermittent part having a coefficient of heat transfer and an area of heat transfer equivalent to those of the corrugated fin of the fluid distributing part.

In the present invention, for the fin having a high coefficient of heat transfer and a large area of heat transfer, a corrugated fin having a large number of corrugations can be used, and for the fin having a low coefficient of heat transfer and a small area of heat transfer, a corrugated fin having a small number of corrugations can be used, and the corrugated fins of different numbers of corrugations can be used in combination in the same passage, and further, different fin materials can be used in combination as required.

DETAILED DESCRIPTION OF THE PREFERRED EMBODIMENT

Description is made of a plate-fin-type heat exchanger wherein air is used for a fluid of high temperature performing continuous operation, and a cold gas is used for a fluid of low temperature performing intermittent operation.

The plate-fin-type heat exchanger of the present invention is configured in a manner that a large number of passages wherein a required corrugated fin is sandwiched between separate fins and is closed with side bars are laminated, and air passages of high temperature side (A passage), cold gas passages of low temperature side (B passage) and dummy passages (D passage) allowing no fluid to pass through are laminated in a 59-state-arranged manner as shown below.

$D_1$, $D_2$, $A_3$, $B_4$, $A_5$, $B_6$ . . . $B_{54}$, $A_{55}$, $B_{56}$, $A_{57}$, $D_{58}$, $D_{59}$ (Note that the sequence of arrangement and the number of stages are shown from the outside of one toward the outside of the other.)

Figure 1:
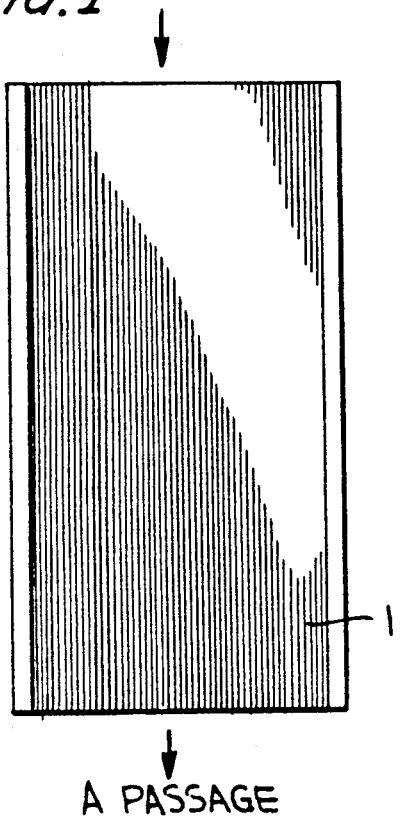
FIG. 1 is an illustrative view showing an A passage of a plate-fin-type heat exchanger in accordance with the present invention.

The A passage has a configuration for passing air downward from above, and as shown in FIG. 1, the fin edge lines are lined up vertically and the number of edge lines per unit length (18 fins/inch) is large, that is, the corrugated fin having a large area of heat transfer and a high coefficient of heat transfer (1) is used.

Figure 2:
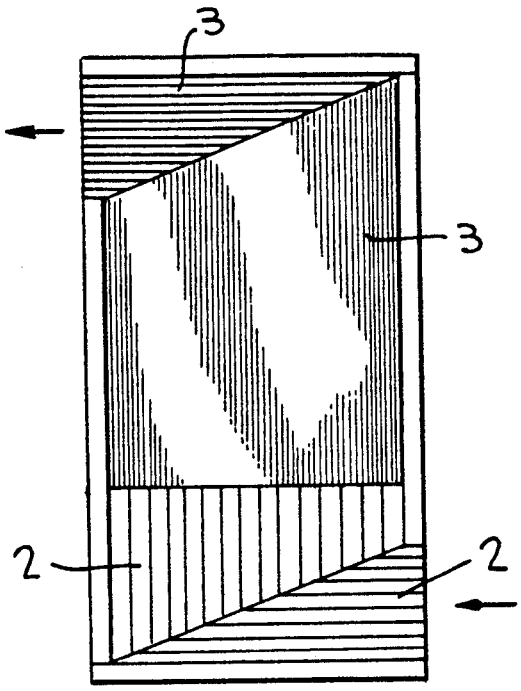
FIG. 2 is an illustrative view showing a B passage of the same.
Figure 3:
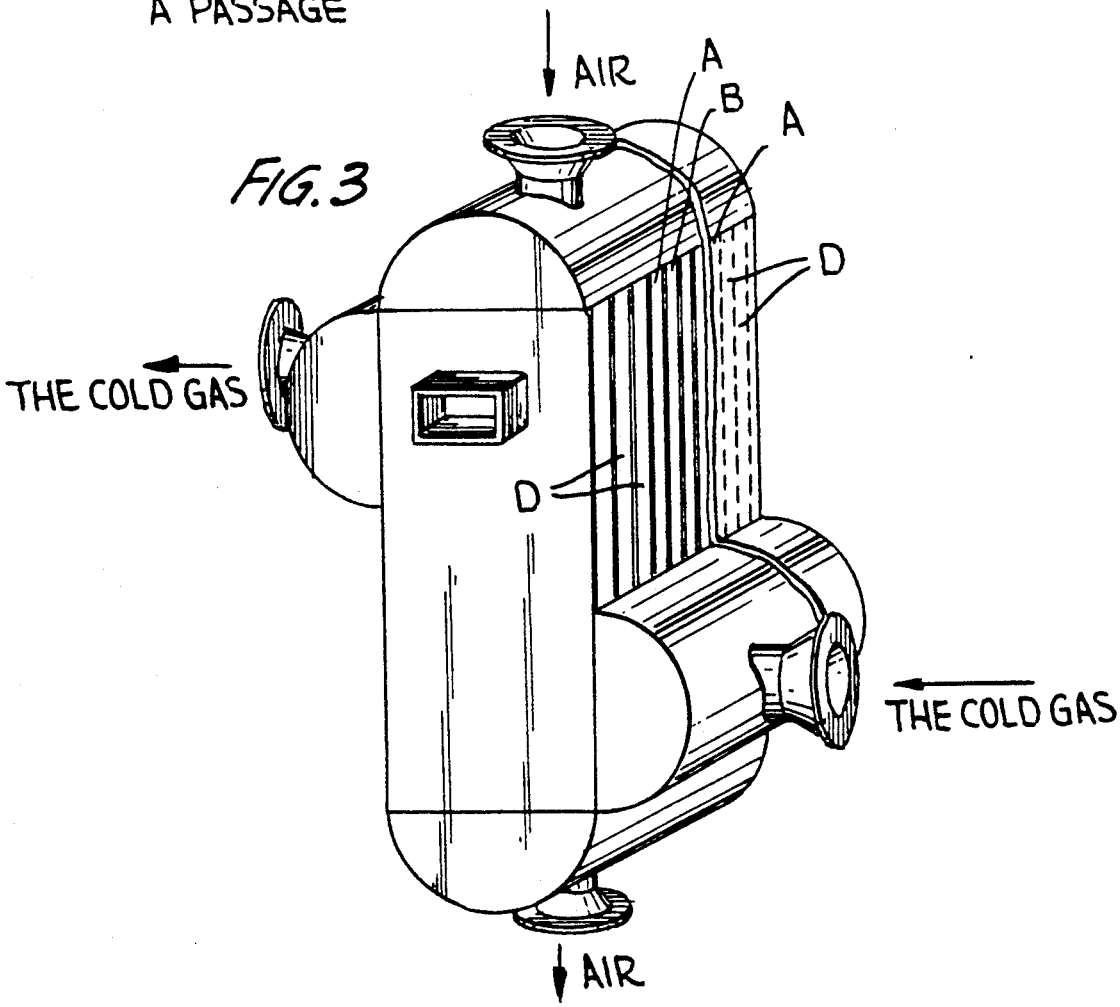
FIG. 3 is a perspective illustrative view showing the plate-fin-type heat exchanger in accordance with the present invention.

The B passage has a configuration for passing a cold gas upward from below, and as shown in FIG. 2, the number of edge lines per unit length (12 fins/inch) is large in the center part (the corrugated fin edge lines are lined up vertically) and the outlet part (two-triangular distributing part) except for the inlet part. This means that the corrugated fin of low coefficient of heat transfer (3) having a performance of about two-thirds of the coefficient of heat transfer of the A passage is used, and further in the inlet part, that is, two-triangular distributing part in the drawing, the corrugated fin having a low coefficient of heat transfer (2) is used which has a number of edge lines per unit length (6 fins/inch) which is one-third of the number of edge lines per unit length of the corrugated fin of the A passage, that is, has a small area of heat transfer.

On the other hand, for the plate-fin-type heat exchanger to be compared, the above-mentioned corrugated fin having a high coefficient of heat transfer (18 fins/inch) is used for both the A passage and the B passage, and only one stage of the D passage is provided, and a plurality of stages are laminated in the sequence of arrangement of D, B, A, B, A . . . A, B, A, B, D.

The above-mentioned plate-fin-type heat exchangers are operated under the same conditions in a manner such that a cold gas is introduced intermittently into the B passages and heat exchange is performed, and the temperature of the cold gas inlet side at the separating plate between the A passage and the B passage of the outermost side was measured. Then, in the heat exchanger to be compared, the temperature difference was 30°–50° between the case of introducing the cold gas and the case of introducing no gas, but in the case of the heat exchanger in accordance with the present invention, the difference is reduced to about 15° C., and generation of thermal stress can be reduced, and it is understandable that the life of the heater exchanger can be extended.

The present invention is optimum for the plate-fin-type heat exchanger wherein one of a fluid of high temperature and a fluid of low temperature performs continuous operation and the other repeats intermittent operation such as the heat exchanger which, to heat a fluid of low temperature, performs heat exchange by periodically passing the fluid of low temperature through the heat exchanger wherethrough a fluid of high temperature flows all the time, or in reverse, the heat exchanger which, to cool a fluid of high temperature, performs heat exchange by periodically passing the fluid of high temperature through the heat exchanger wherethrough a fluid of low temperature flows all the time.

For example, when the present invention is applied to the preheater for reproducing molecular sieves having a configuration that cool waste gas flows periodically into the heat exchanger the whole of which has become the air temperature and heat exchange is repeated intermittently, generation of thermal stress due to the temperature difference can be reduced, and the extended life of the heat exchanger can be achieved, and thereby the best effect can be expected.

We claim:

1. A plate-fin-type heat exchanger for transferring heat from a hot fluid to a cold fluid, said heat exchanger defining opposite first and second sides, opposite third and fourth sides and opposite first and second ends, said heat exchanger including a plurality of parallel plates which are stacked between said first and second sides and which includes fins that define alternate interdigitated first and second fluid passages, said fins defining said first fluid passages having a high coefficient of heat transfer and a large area of heat transfer, said first fluid passages being intended to continuously convey a first of said hot and cold fluids, and said fins defining said second fluid passages having a low coefficient of heat transfer and a small area of heat transfer, said second fluid passages being intended to intermittently convey a second of said hot and cold fluids.

2. A heat exchanger as defined in claim 1, wherein said first fluid passages are straight and have inlets at said first end and outlets at said second end, and said second fluid passages have inlets at said third side and outlets at said fourth side.

3. A heat exchanger as defined in claim 2, wherein, starting from said third side, said second fluid passages have a first portion which extend towards said fourth side, second and third portions which extend in parallel with said first passages and a fourth portion which extends to said fourth side.

4. A heat exchanger as defined in claim 3, wherein said third portion of said second fluid passage includes more fins than said first or second portions.

* * * * *